US012370644B2

(12) United States Patent
Buchenauer et al.

(10) Patent No.: US 12,370,644 B2
(45) Date of Patent: Jul. 29, 2025

(54) INSTALLATION AND METHOD FOR PROCESSING OPHTHALMIC LENSES

(71) Applicant: Schneider GmbH & Co. KG, Fronhausen (DE)

(72) Inventors: Helwig Buchenauer, Dautphetal-Buchenau (DE); Gunter Schneider, Marburg (DE)

(73) Assignee: Schneider GmbH & Co. KG, Fronhausen (DE)

( * ) Notice: Subject to any disclaimer, the term of this patent is extended or adjusted under 35 U.S.C. 154(b) by 0 days.

(21) Appl. No.: 18/144,931

(22) Filed: May 9, 2023

(65) Prior Publication Data

US 2023/0271294 A1 Aug. 31, 2023

Related U.S. Application Data

(63) Continuation-in-part of application No. PCT/EP2021/081138, filed on Nov. 9, 2021.

(30) Foreign Application Priority Data

Nov. 10, 2020 (DE) ..... 10 2020 006 895.2
May 10, 2022 (EP) ..... 22172515

(51) Int. Cl.
*B24B 13/00* (2006.01)
*B24B 27/00* (2006.01)

(52) U.S. Cl.
CPC ..... *B24B 13/0037* (2013.01); *B24B 27/0069* (2013.01)

(58) Field of Classification Search
None
See application file for complete search history.

(56) References Cited

U.S. PATENT DOCUMENTS 5,372,241 A * 12/1994 Matsumoto ..... G06Q 10/08 198/465.4
5,744,357 A * 4/1998 Wang ..... B29D 11/00221 264/1.32

(Continued)

FOREIGN PATENT DOCUMENTS

CN 110844549 A 2/2020
DE 3916424 A1 11/1990

(Continued)

OTHER PUBLICATIONS

International Search Report for International Application No. PCT/EP2021/081138, mailed Mar. 17, 2022.

(Continued)

*Primary Examiner* — Kavel Singh
(74) *Attorney, Agent, or Firm* — Jason H. Vick; Amped IP LLC

(57) ABSTRACT

One exemplary embodiment relates to an installation and a method for processing ophthalmic lenses, with several processing devices for processing the lenses. The embodiment includes a conveying device connecting the processing devices for transporting lens carriers to and from the processing devices, and with a transfer device for changing transport tracks as required. According to the embodiment, it is provided that the processing devices are arranged in front of the first transport track and that the transfer device is designed as a pushing device with a fork-shaped guide device which guides the lens carriers laterally and in the direction of conveyance.

20 Claims, 8 Drawing Sheets

(56) References Cited

U.S. PATENT DOCUMENTS

| | | | | |
|---|---|---|---|---|
| 5,804,107 | A * | 9/1998 | Martin | B29D 11/0048 425/347 |
| 6,336,546 | B1 * | 1/2002 | Lorenz | H01L 21/67736 198/346.2 |
| 7,014,033 | B2 * | 3/2006 | Sticht | B65G 43/10 198/465.1 |
| 7,040,886 | B2 * | 5/2006 | Calvin | B29C 31/006 414/222.11 |
| 7,156,646 | B2 * | 1/2007 | Calvin | B29C 31/006 414/222.11 |
| 9,840,373 | B2 | 12/2017 | Schneider | |
| 10,549,400 | B2 * | 2/2020 | Gerrath | B24B 9/148 |
| 10,773,894 | B2 * | 9/2020 | Meschenmoser | B65G 35/06 |
| 10,781,050 | B2 | 9/2020 | Schneider | |
| 10,947,053 | B2 * | 3/2021 | Meschenmoser | B65G 47/53 |
| 2017/0107003 | A1 | 4/2017 | Duchemin et al. | |
| 2017/0144842 | A1 | 5/2017 | Huang | |
| 2021/0170540 | A1 | 6/2021 | Schneider | |

FOREIGN PATENT DOCUMENTS

| | | | |
|---|---|---|---|
| DE | 202005015268 | U1 | 2/2007 |
| DE | 102007059303 | A1 | 6/2009 |
| DE | 102018007494 | A1 | 3/2020 |
| EP | 1634827 | A1 | 3/2006 |
| EP | 2822883 | B1 | 5/2017 |
| WO | WO 00/30960 | A1 | 6/2000 |
| WO | WO 2013/131656 | A2 | 9/2013 |

OTHER PUBLICATIONS

Written Opinion for International Application No. PCT/EP2021/081138, mailed Mar. 17, 2022.

* cited by examiner

INSTALLATION AND METHOD FOR PROCESSING OPHTHALMIC LENSES

CROSS-REFERENCE TO RELATED APPLICATIONS

The present application is a Continuation-in-Part of International Application No. PCT/EP2021/081138, filed Nov. 9, 2021, which claims priority to German Patent Application No. 10 2020 006 895.2, filed Nov. 10, 2020, and of European Patent Application No. 22 172 515.3, filed May 10, 2022, the entire disclosures of each are incorporated herein by reference in their entirety.

BACKGROUND

The present invention relates to an installation for processing ophthalmic lenses and a method for processing ophthalmic lenses.

The processing of ophthalmic lenses, in particular of spectacle lenses and/or eyeglass lenses, takes place in several separate processing devices. In particular, the processing can include shaping, preferably machining, polishing, testing and/or measuring, marking, cleaning and/or coating.

To link the processing devices, conveyor systems with conveyor belts, such as belt conveyors, are usually used for serial processing. These conveyors transport the ophthalmic lenses and/or lens carriers loaded with ophthalmic lenses from one processing device to the other.

WO 2013/131656 A2 discloses an installation for processing of optical lenses for eyeglasses in several separate processing devices. Each processing device comprises its own conveyor belt for conveying lens carriers to and from the processing devices. A transfer system with a first transport track for conveying lens carriers from one processing device to the next and with a second parallel transport track for conveying lens carriers in parallel serves to convey the lens carriers further. Furthermore, the transfer system comprises transfer devices arranged between the processing devices for changing between the transport tracks. The first transport track runs through the processing devices and is composed of the transfer devices and the conveyor belts of the processing devices, whereby the transfer devices and these conveyor belts can each be controlled and driven independently.

The transfer equipment includes lifting devices in the first and second transport tracks, a cross conveyor belt and a conveyor belt in the longitudinal direction. Accordingly, there is a complex structure for the installation, the transfer system and the transverse conveyor.

DE 10 2018 007 494 A1 discloses an integrated, very compact processing installation for processing spectacle lenses with several processing stations and a common transport system with common manipulation devices for feeding the various work stations with spectacle lenses to be processed. It is therefore a very compact processing installation, but not aimed at a flexible interlinking of separate processing devices.

US 2017/0144842 A1 discloses an installation for circulating and sorting contact lenses, wherein the contact lenses are each held in a block-shaped holder and the holders are displaced by sliding cylinders.

SUMMARY

The present invention is based on the task of specifying an installation and a method for processing ophthalmic lenses, whereby a flexible linking of separate processing devices is made possible with a simple, cost-effective structure.

The above task is solved by an installation and by a method as disclosed herein.

The installation according to the proposal comprises several separate processing devices for independent processing of ophthalmic lenses, in particular lenses for spectacles.

A first aspect of the present invention is that the conveying device preferably forms a continuous first transport track in front of the separate processing devices, each comprising its own housing, wherein the processing devices each comprise their own manipulation device for picking up lenses from the first transport track for processing.

Particularly preferably, the first transport track runs in a straight line, with the processing devices preferably being arranged along the first transport track, in particular on only one side.

Particularly preferably, the conveying along the first transport track for providing the lenses to be processed and/or lens carriers with the lenses to be processed as required is carried out exclusively by the (common) conveying device, i.e. in particular centrally controlled, while the pick-up of the lenses to be processed by the respective manipulation device of the respective processing device is carried out individually by the respective processing device, i.e. "locally" and/or decentrally controlled.

Particularly preferably, the conveying is carried out by a conveyor belt or by a plurality of conveyor belts, the conveyor belt and/or belts preferably being operated continuously and the lens carriers being individually halted and/or stopped by corresponding stopping devices. These stopping devices are preferably in turn associated with the conveying device and/or are controlled by it and/or centrally.

Accordingly, the linking of several independent processing devices—in particular a supplementation and adaptation—is particularly easy to realize, since the processing device required in each case only has to be arranged along the first transport track, but no further mechanical integration into the (common) conveying device has to take place. Accordingly, this results in a very cost-effective and universally adaptable installation for processing ophthalmic lenses.

A second aspect of the present invention, which can also be realized independently, is that at least one transfer device, in particular several transfer devices or each transfer device is/are designed as a pushing device, wherein the pushing device is designed to push and/or pull the respective lens carrier from one transport track to the other transversely to the conveying device for changing the transport track and preferably optionally to position it in an intermediate position.

When shifting and/or changing lanes, the lens carrier is preferably guided both in conveying device and transversely thereto and/or laterally.

Particularly preferably, the lens carriers for changing the transport track and/or into an intermediate position are moved and/or pushed or pulled—preferably exclusively—by primarily lateral force action without active lifting.

In particular, the conveyor belt forming the first and/or second transport track can run continuously while a safe track change is enabled and/or ensured in a structurally simple manner.

Accordingly, a simple and cost-effective realization of the installation and the process is made possible.

A third aspect of the present invention, which can also be implemented independently, provides that the conveying device preferably comprises a common conveyor belt with two transport tracks and an intermediate area for the lens carriers arranged therebetween, so that at least one lens carrier can be positioned on the conveyor belt between the transport tracks as required.

Preferably, the lens carrier is held in the intermediate area, in particular by a stop device or the like projecting from above, so that the conveyor belt can continue to run continuously even if the lens carrier remains and/or is held temporarily in an intermediate position in the intermediate area.

Alternatively or additionally, the pushing device for changing the transport tracks can also hold the lens carrier in the intermediate area and/or in the intermediate position, if necessary.

The common conveyor belt with intermediate area enables a particularly simple and thus cost-effective implementation, which can also be very easily adapted to different conditions and requirements.

The processing devices are preferably positioned on a continuous conveying device and/or on a continuous conveyor belt. The conveying device serves to guide the ophthalmic lenses, in particular on lens carriers, to and/or from the individual processing devices.

Preferably, the continuous conveying device comprises two transport tracks, in particular to allow independent parallel processing of the ophthalmic lenses in the separate processing devices. The first transport track is used in particular for transporting the ophthalmic lenses and/or lens carriers from one processing device to the next and the second transport track is used for parallel transport, in particular as an overtaking track, on which the ophthalmic lenses and/or lens carriers which are not to be and/or cannot be fed to a processing device are transported further.

Preferably, the conveying device comprises at least one continuous conveyor belt and at least one drive system, wherein the conveying device is now continuous with respect to the direction of conveyance and is not composed of separate subunits.

Preferably, only one continuous conveying device is now provided for both transport tracks, particularly preferably with only one continuous conveyor belt. Concomitantly, in particular substantially fewer drive systems, especially preferably only one drive system, are required for operating the conveying device. This permits substantially lower control and assembly costs.

Preferably, each processing device is directly adjacent to the first transport track, i.e. the first transport track preferably runs directly past the processing devices and not through the processing devices.

For the purposes of the present invention, the term "directly adjacent" is to be understood primarily as meaning that the first transport track runs directly past the processing devices and does not pass through the processing devices.

Preferably, the processing devices are positioned directly, in particular essentially without gaps and/or distances, on the first transport track. This enables simpler maintenance work and less complex assembly and/or expansion of the installation to include further processing devices, since these now only have to be moved and connected directly to the conveying device and/or transport track.

Preferably, therefore, the term "directly adjacent" should also be understood to mean that the processing devices and the transport track and/or the conveying device are directly adjacent to each other, in particular at least essentially without distance and/or gaps.

Optionally, however, the processing devices can also be spaced from the conveying device, in particular from the first transport track. The distance is preferably limited by the reach of the respective manipulation device for loading and unloading the processing devices.

In principle, all known lens carriers are suitable for the proposed installation and for the proposed method. The most common lens carriers comprise, in a manner known per se, two holding positions for holding up to two ophthalmic lenses, as is customary in lens and/or ophthalmic lens production. The lens carriers are used to pre-position the ophthalmic lenses in such a way that the processing devices can be loaded particularly reliably. The ophthalmic lenses can also be removed from the lens carriers individually.

The distance between the pick-up locations for the ophthalmic lenses within a lens carrier is preferably the same as the distance between a pick-up location in a lens carrier and the neighboring pick-up location in an immediately adjacent lens carrier. This simplifies the handling and/or positioning of the ophthalmic lenses, especially in the holding area of the processing devices for loading and unloading the processing devices with ophthalmic lenses.

Transfer devices are required to transport and/or change the ophthalmic lenses and/or lens carriers from one transport track to another.

According to a particularly preferred aspect of the present invention, which can also be implemented independently, each transfer device is designed as a pushing device which pulls and/or pushes the ophthalmic lenses and/or lens carriers, in particular transversely to the direction of conveyance, from one transport track to the other, as mentioned above.

The ophthalmic lenses and/or lens carriers are conveyed by means of the pushing device from one transport track to the other, preferably transversely to the direction of conveyance, and particularly preferably along the shortest path, i.e. at an approximately right angle relative to the direction of conveyance. However, transverse conveying can also take place at other angles with respect to the direction of conveyance. In particular, diagonal conveying can be performed with respect to the direction of conveyance, preferably both along and against the direction of conveyance. The lens carriers are conveyed transversely by the pushing devices in particular in such a way that the lens carriers are conveyed particularly reliably and as quickly as possible from one transport track to the other.

In particular, the pushing device enables transverse conveying while the conveyor belt is running or transverse conveying without stroke. In other words, a simpler and faster transfer is possible.

Preferably, conveyor belts are provided with a particularly smooth surface, in particular without shoulders and unevenness, especially preferably link belts with a smooth surface. One advantage of conveyor belts in the form of continuous link belts is that the lens carriers do not have to travel precisely on a transport track, but that lens carriers of different dimensions can be conveyed. For example, it is possible to convey lens carriers of different widths on a conveyor belt, provided that the lens carrier is not wider than the respective transport track.

After ophthalmic lenses have been processed at a processing device, the ophthalmic lenses can be deposited at their pick-up positions on the respective lens carrier on the first transport track and conveyed to a pushing device downstream of the respective processing device. If it is now desired to process the ophthalmic lenses not at the nearest processing device, but at a processing device further away, the lens carrier with the processed ophthalmic lenses is pushed by means of the pushing device from the first to the second transport track transversely to the direction of conveyance, so that overtaking of the processing device nearest in the direction of conveyance is made possible on the second transport track. The ophthalmic lenses to be processed and/or the lens carrier, which are now on the second transport track, can be pushed by means of the pushing device from the second transport track to the first one transversely to the direction of conveyance as soon as they reach a pushing device which is located in front of the processing device at which the next processing is to take place.

In the event that it is necessary or desirable to stop the lens carriers, e.g. in the case of a high volume of lens carriers, in the stopping area in front of the processing devices or in front of a pushing device, in particular to avoid a collision with lens carriers, stopping devices are provided on the transport tracks, in particular in such a way that the conveying device and/or its conveyor belt or conveyor belts can continue to be operated continuously.

According to a particularly preferred aspect of the present invention, which can also be implemented independently, each pushing device comprises a fork which can be moved in particular transversely to the conveying device. This serves in particular to carry the lens carriers from one transport track to another as required. Preferably, the fork is designed in such a way, and/or the opening of the fork is preferably oriented opposite to the direction of conveyance, that the lens carriers can pass through and/or under the fork while the conveyor belt is running, in particular since the lens carriers are not clamped between the holding arms of the fork (see below). The fork of the pushing device ensures that only one continuous conveying device is required and not separate sub-units of a transfer device for transverse conveying.

A further aspect of the present invention, which can also be implemented independently, is that the pushing device comprises a height-adjustable fork. An advantage of this further embodiment is that the lens carriers can leave the pushing device more quickly due to rapid raising of the fork while the conveyor belt is running. This serves in particular to prevent a buildup of lens carriers and/or to achieve a higher throughput.

In the event of a buildup of lens carriers, in particular in front of a pushing device, i.e. either in front of a fork occupied by a lens carrier or on the opposite transport track to which the lens carrier is to be pushed by means of the fork, stopping devices are provided to stop the lens carriers. These are preferably positioned on the conveying device in such a way that the following lens carriers do not accumulate behind and/or collide with another lens carrier while the conveyor belt is running, and/or the waiting position to which a lens carrier is to be pushed by means of the fork of the pushing device is not occupied before the transverse conveying by the pushing device has taken place.

Particularly preferably, the pushing device comprises a linear drive for transverse conveyance of the fork, which in particular pushes the ophthalmic lenses and/or lens carriers from one transport track to the other.

Preferably, the fork of the pushing device can be moved in both directions transverse to the direction of conveyance. This allows significantly lower material and assembly costs, since only a single driven pushing device, which pushes the ophthalmic lenses and/or lens carriers from one transport track to the other, is necessary instead of transfer devices consisting of several separately driven subunits.

Particularly preferably, the pushing devices are arranged on the conveying device, preferably between two processing devices and/or before and/or after each processing device. This has the advantage that the arrangement of the pushing devices is independent of the location and/or position of the processing devices.

Alternatively or additionally, the pushing devices can also be attached directly to the processing devices, in particular on the side of each processing device that can be reached first with respect to the direction of conveyance for the lens carrier. This means that if the installation is modified, e.g. by adding additional processing devices, no further pushing devices need to be attached to the conveying device, but can be pushed directly to the conveying device with the processing devices.

It is also conceivable to arrange several, preferably two, pushing devices directly behind each other on the conveying device or also on the processing devices. This primarily serves the purpose of achieving a higher throughput as well as a smooth and/or delay-free process. If, for example If, for example, a first lens carrier is to be pushed from the second transport track to the first transport track during a running conveyor belt, so that the corresponding ophthalmic lenses of the first lens carrier can be processed at a subsequent processing device in relation to the direction of conveyance, while a second lens carrier is located on the first transport track in the area in front of the pushing devices in relation to the direction of conveyance, which must first be pushed to the second transport track, so that the area on the first transport track in front of the processing device becomes free for the first lens carrier to be processed, the second lens carrier can be pushed from the first transport track onto the second transport track by means of a first pushing device, while a subsequent pushing device in relation to the direction of conveyance can push the first lens carrier to be processed from the first transport track onto the second.

It is also conceivable, of course, that two lens carriers conveyed one behind the other on one transport track each enter the fork of the two pushing devices arranged one behind the other and are pushed in parallel onto the other transport track.

If the number of lens carriers is low, the lens carriers can also be pushed separately from one transport track to the other using either the first or second pushing device in relation to the direction of conveyance, depending on the desired position of the lens carriers on the conveying device.

One possible embodiment of the proposed installation is that the conveying device comprises a conveyor belt with two transport tracks and a common drive system. This is associated with low assembly costs and particularly simple cross-conveying, since the two transport tracks run on a common conveyor belt and the pushing device or its fork therefore only has to be moved on a running conveyor belt at right angles to the direction of conveyance.

In a particularly preferred embodiment, the conveying device comprises two separate conveyor belts, each in the form of a transport track and preferably a common drive system. Preferably, a space is provided between the two separate conveyor belts, forming an intermediate space. Stop devices and/or various measuring devices, such as sensors, can be accommodated in this intermediate space, resulting in a smaller space or area requirement for the installation due to the relocation to the inside between the two conveyor belts. As a result, more space is available for the processing devices as well as for an operator. In addition, this enables a more favorable connection of the processing devices to the conveying device.

However, it is also conceivable that the conveying device comprises two conveyor belts, each in the form of a transport track, with either one drive system per conveyor belt or, particularly preferably, a common drive system, in particular with an epicyclic gear unit known per se. This design allows independent operation of the conveyor belts and/or transport tracks, in particular at different speeds. This can be advantageous, for example, if several lens carriers are to be conveyed past several processing devices in the overtaking lane in order to avoid a build-up of lens carriers and/or to convey lens carriers loaded with ophthalmic lenses more quickly to a more distant processing device and/or to achieve a higher throughput.

The particularly preferred embodiment of the proposed installation with two spaced conveyor belts provides that each pushing device is assigned an intermediate position and/or intermediate plate arranged between the conveyor belts. This serves to bridge the distance between the conveyor belts in such a way that cross-conveying of the ophthalmic lenses and/or lens carriers from one conveyor belt to the other can be carried out particularly reliably.

The intermediate position and/or intermediate plate can also be used for temporary storage of a lens carrier, i.e. serve as a waiting position, e.g. to achieve a higher throughput. If, for example, a first lens carrier is to be overtaken on a transport track so that a subsequent second lens carrier can reach the following processing device first, e.g. if this is free at this time for processing the corresponding ophthalmic lenses of the second lens carrier, the first lens carrier can be pushed onto the intermediate plate by means of the fork of the pushing device and temporarily stored there so that the second lens carrier can overtake the first.

Conveniently, the width of the intermediate position and/or of the intermediate plate preferably corresponds at least to the width of a lens carrier.

Another aspect of the present invention, which can also be implemented independently, is that the width of the conveying device and/or conveyor belts is determined by the width of the lens carrier.

Preferably, the width of a transport track corresponds at least to the width of a lens carrier. It follows that the width of the conveying device preferably corresponds to at least the number of transport tracks multiplied by the width of the lens carrier.

In the previously explained proposed design with two transport tracks on a conveyor belt on a conveying device, the width of the conveyor belt and the conveying device is at least twice the width of the lens carrier.

In the particularly preferred embodiment of two spaced conveyor belts and/or transport tracks on a conveying device, the width of the conveying device is at least twice the width of the lens carrier supplemented by the width of the distance between the conveyor belts, and the width of the respective conveyor belt is at least equal to the width of the lens carrier.

Generally, in the case of several, i.e. at least two conveyor belts, the width of the conveying device corresponds at least to the product of the number of conveyor belts and the width of the lens carrier, in particular plus the respective distance between the conveyor belts.

Preferably, the installation according to the proposal comprises guide bars, especially at the edges of the conveyor belts, parallel to the direction of conveyance, especially for guiding the ophthalmic lenses and/or lens carriers. This enables the lens carriers to be guided at least essentially in a straight line along the transport tracks on the conveyor belts and/or prevents the lens carriers from running at an angle and/or falling off the installation.

In the area of the pushing devices, in the case of at least two spaced conveyor belts, recesses are preferably provided in the guide bars, in particular corresponding to the dimensions of the lens carriers. This design allows simple, fast transverse conveying without lifting the lens carrier from one conveyor belt to the other. The lens carriers are guided parallel to the direction of conveyance through and/or into the fork by the side elements of the fork.

According to another aspect of the present invention, the installation according to the proposal is configured such that a circulation of ophthalmic lenses and/or lens carriers can take place in a circuit. This enables the ophthalmic lenses and/or lens carriers to approach the processing devices repeatedly and/or in any order, and the order of processing, the utilization of the processing devices, and the processing sequences can be varied and/or optimized. In this way, a buildup of lens carriers can be prevented, especially before or at processing devices.

A possible embodiment of the circulation is that the conveying device of the installation according to the proposal is and/or can be extended or connected to form an installation. In particular, this permits circulation or recirculation of the ophthalmic lenses and/or lens carriers. Such an installation can consist of one or more conveyor belts, in particular in the form of a ring or ellipse, with one or two transport tracks. In the case of several conveyor belts, these can be spaced apart and/or directly adjacent to each other.

Particularly preferably, the conveying device of such a plant system is driven by a common drive system, but may also comprise several drive systems. Preferably, the processing devices are arranged along the long, at least substantially straight lines of the, preferably elliptical, plant system, but may also be arranged at any other desired location, such as inside or on the shorter sides of the plant system.

In accordance with another aspect of the present invention, multiple conveying devices may also form a plant system.

A preferred embodiment of such a plant system of the installation according to the proposal is a U-shaped or ring-like arrangement with two conveying devices facing each other, wherein preferably a conveyor belt with one or two transport tracks or two spaced conveyor belts in the form of one transport track each are provided.

Along the conveying devices facing each other, several processing devices are preferably arranged in a row in a manner known per se, which are preferably directly adjacent to the first transport track.

Preferably, connecting elements are provided for the circulation of the ophthalmic lenses and/or lens carriers, e.g. curved sections or transverse connecting sections, which connect the conveying devices opposite each other, in particular around the corner and/or around the curve. Curved conveying ensures that the alignment of the ophthalmic lenses and/or lens carriers remains constant with respect to the respective direction of conveyance.

According to a particularly preferred aspect of the aforementioned embodiment of the proposed installation, each of the two conveying devices facing each other comprises two conveyor belts, each in the form of a transport track, which are connected to each other via pushing devices. Particularly preferably, the second transport tracks of the conveying devices are each connected to each other via connecting elements, such as curved pieces and/or transverse connecting pieces, in order to ensure circular conveying. The pushing devices have the function of transporting the ophthalmic lenses and/or lens carriers from one transport track to another or of pushing all ophthalmic lenses and/or lens carriers that are to be transported from one conveying device to the opposite one onto the second transport track.

According to another aspect of the present invention, the installation according to the proposal comprises more than two transport tracks, particularly preferably a third transport track for parallel conveying, in particular return conveying, of ophthalmic lenses and/or lens carriers.

Preferably, the first and second transport tracks have opposite directions of conveyance to the third transport track.

A preferred embodiment of the proposed installation is that the first and second transport tracks run in one direction and a third transport track runs parallel to them in the opposite direction of conveyance. The third transport track is used to return the ophthalmic lenses and/or lens carriers. Preferably, therefore, several processing devices are arranged along the first transport track, while the third transport track serves only for return conveying.

According to a particularly preferred aspect of the above-mentioned embodiment of the present invention, only one common drive system is provided for all three transport tracks on one conveyor belt each on a common conveying device. The reversal of the directions of conveyance and/or the drive of the third transport track is carried out, for example, in a manner known per se by means of a planetary gear.

Furthermore, pushing devices are provided for changing transport tracks, preferably at right angles to the direction of conveyance, in particular between the processing devices, which can push the ophthalmic lenses and/or lens carriers over two or three transport tracks. The pushing devices running over three transport tracks allow circulation and/or circular conveying of the ophthalmic lenses and/or lens carriers on the three-track conveying device. In particular, the conveyed ophthalmic lenses or lens carriers can be repeatedly conveyed to and/or from the processing devices.

According to a particularly preferred aspect of the proposed embodiment, the pushing devices, which are preferably arranged between the processing devices, can be used to initiate a return conveyance after each processing device, in particular via the third transport track, and not only at the end of the conveying device. This makes it possible to avoid jams on lens carriers and, in particular, to achieve a higher throughput, since the lens carriers can be circulated over shorter distances and do not have to be conveyed back over the entire distance of the third transport track before they are pushed again via a pushing device onto the first transport track adjacent to the processing machines.

According to a particularly preferred aspect of such an installation according to the proposal, the three-track conveying device can be connected to at least one further, preferably opposite conveying device. The connection can be made, for example, via the above-mentioned connecting elements. Conceivable here are connections on both sides of the conveying devices to form a ring or also U-shaped arrangements in which one side of the conveyor belts remains open by omitting the connecting elements and thus the intermediate space between the two preferably parallel conveying devices remains accessible to an operator.

The two conveying devices and/or rows of processing devices in this plant system are preferably spaced apart in such a way that the intermediate space forms an access possibility for an operator. This is particularly easy for an operator to reach in the case of a U-shaped arrangement. In the case of a ring-shaped arrangement, the connecting elements are designed in such a way that they can be loosened and/or opened or folded away as required for access to the intermediate space. Alternatively or additionally, these can also be placed higher or lower and/or connected, for example, via vertical conveyors or downhill sections, so that preferably free access to the intermediate space is ensured.

The intermediate space can alternatively or additionally be used in a manner known per se for containers for operating fluids of the processing devices, such as containers for chips, polishing agents or coolants. However, the containers can also be arranged below the conveyor belts. In this way, the intermediate space can be used for other purposes or reduced in size if necessary, and thus the entire plant system can be kept narrower in order to save space.

In a further embodiment of the proposed installation, the processing devices are not arranged outside the ring-like and/or U-shaped installation, but in the space between the two conveying devices and preferably in such a way that the space between them is kept as narrow as possible, but an operator can still reach each processing device easily and quickly. In addition to a considerable saving in space due to the elimination of the processing devices projecting outwards, a further advantage of this alternative embodiment is that the operator has a shorter path from one processing device to another.

Particularly preferably, the three-track conveying device is combined with a two-track conveying device with two transport tracks running in the same direction, in particular a first and a second transport track. In this embodiment, several processing devices are arranged along each of the conveying devices, in particular along the first transport tracks, preferably in a row. The three-track conveying device with the returning third transport track preferably serves as an express line with the task of ensuring a high throughput.

According to a further aspect of the installation according to the proposal, the third transport track and the above-mentioned connecting elements can also be combined, if required.

It is conceivable, for example, that the second transport track is connected to the third transport track, which runs parallel to and in the opposite direction to the second transport track, around the curve and/or corner by known connecting elements.

In the installation known from WO 2013/131656 A1, the conveyor belts associated with the first transport track and assigned to the processing devices are each controlled separately by the machine control system and do not form part of the transfer control system, i.e. the conveyor system is not controlled centrally by one control system but by several control systems, namely a central control system and a machine control system.

In the installation and/or process according to the proposal, on the other hand, a control system is provided, in particular a central control system, which controls the entire conveying system, i.e. the conveying device including conveyor belts and/or transport tracks, pushing devices and stopping devices, in the holding area in front of the respective processing devices. The processing devices are controlled independently and/or separately of the central control system, i.e. by their own machine control system, in order to allow independent processing. It is alternatively also possible that the stopping devices are also controlled by the machine control.

This shift of the automation to a central control system enables considerably simplified assembly, conversion and maintenance work of the installation according to the proposal, in particular since the processing devices with their own machine controls only have to be connected to the centrally controlled conveying device and to no additional separate conveyor belts assigned to the processing devices.

This makes it much easier to expand the proposed installation to include additional processing devices and/or to form an installation.

Individual ones of the foregoing and subsequent aspects and features of the present invention may be combined with each other in any desired manner, but may also be implemented independently of each other.

Further aspects, features, advantages and properties of the present invention are apparent from the claims and the following description of preferred embodiments and/or examples of embodiments with reference to the figures. It show in schematic, not to scale representation:

DETAILED DESCRIPTION

In the figures, the same reference signs are used for the same components and parts, resulting in corresponding properties and advantages, even if a repeated description is omitted.

Figure 1:
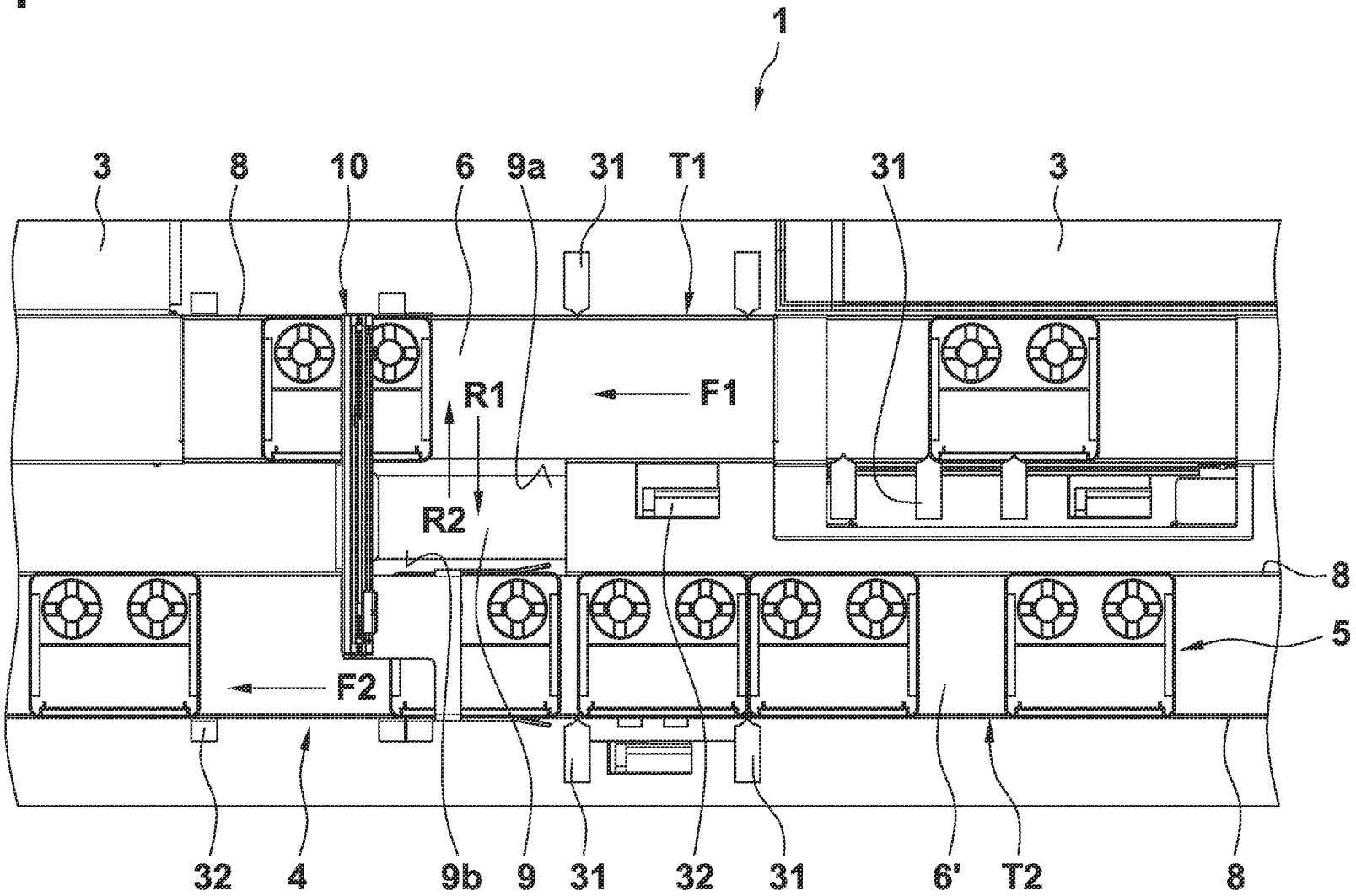
FIG. 1 a schematic section of a proposed installation with a conveying device, two processing devices and a pushing device arranged between them in a plan view.

FIG. 1 shows a schematic section of a preferred embodiment of an installation 1 according to the proposal for processing, in particular ophthalmic, lenses 2.

The ophthalmic lens 2 is preferably a spectacle lens, i.e. a lens for spectacles and/or eyeglasses.

The ophthalmic lens 2 is preferably made of plastic, but can also be made of glass or another material if necessary.

The installation 1 according to the proposal preferably comprises several, separate, processing devices 3 for, in particular, independent processing of the ophthalmic lenses 2.

The installation 1 preferably comprises different processing devices 3, e.g. for blocking, for shaping, in particular machining, for polishing, for testing or measuring, for marking, for cleaning and/or for coating ophthalmic lenses 2.

Further, not only different types of processing devices 3 but also several of the same type can be integrated into the installation 1 for the same processing.

As shown in FIG. 1, the proposed installation 1 comprises a conveying device 4 for transporting the ophthalmic lenses 2 and/or for transporting the lens carriers 5, in particular from one processing device 3 to another. The conveying device 4 comprises the task of feeding the ophthalmic lenses 2 and/or lens carriers 5 to the respective processing device 3, conveying them from one processing device 3 to another processing device 3 after processing comprises been completed, and/or guiding them away from a processing device 3.

The conveying of ophthalmic lenses 2 and/or lens carriers 5 onto the conveying device 4 can take place for example by means of a pick-up station (not shown). The lenses 2 and/or lens carriers 5 can be removed from the conveying device 4 by means of a delivery station (not shown).

Figure 2:
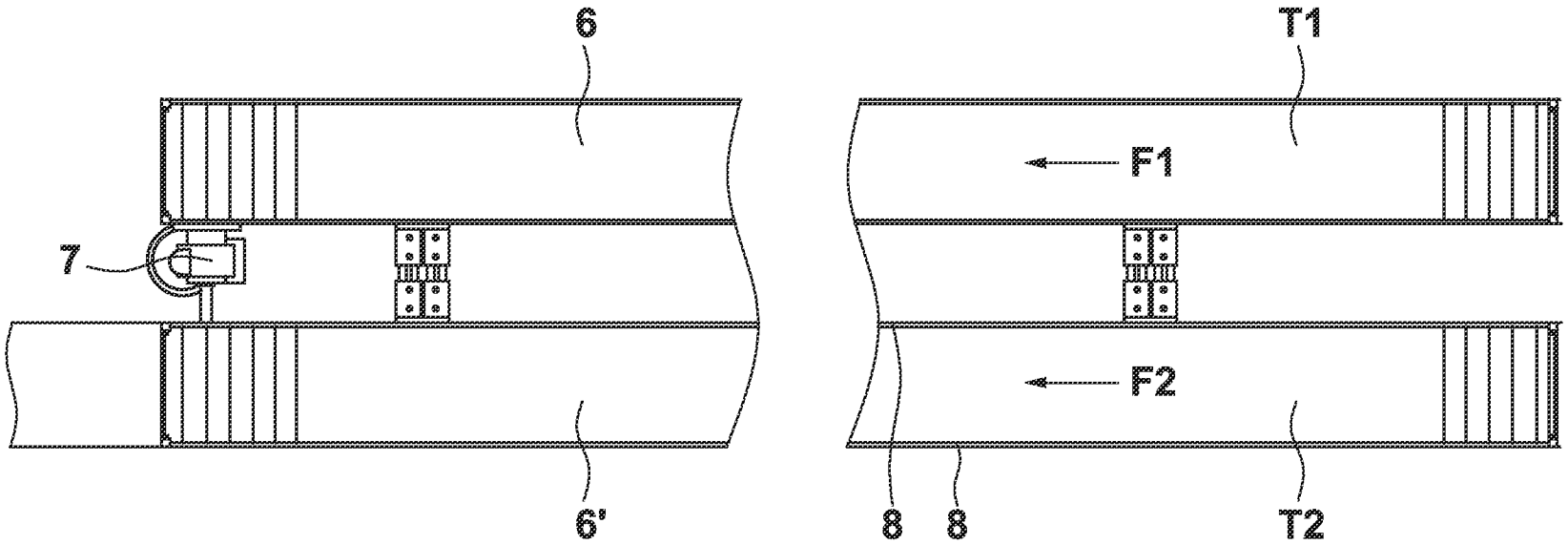
FIG. 2 a schematic partial representation of the conveying device of the proposed installation according to FIG. 1.

The conveying device 4 comprises preferably at least one conveyor belt 6, in particular a continuous conveyor belt 6, preferably two continuous conveyor belts 6, 6', as indicated in FIGS. 1 and 2.

Further, the conveying device 4 preferably comprises two transport tracks T1, T2, in particular wherein the conveyor belts 6, 6' are each formed by at least one transport track T1, T2.

In the illustration example, the conveyor belts 6, 6' correspond to the respective transport track T1, T2 (FIGS. 1 and 2). In particular, the conveyor belts 6, 6' form the respective transport track T1 and T2.

In an alternative embodiment (or further embodiment shown in FIG. 8), at least the conveyor belt 6 comprises or forms several, in particular two, transport tracks T1, T2.

Figure 8:
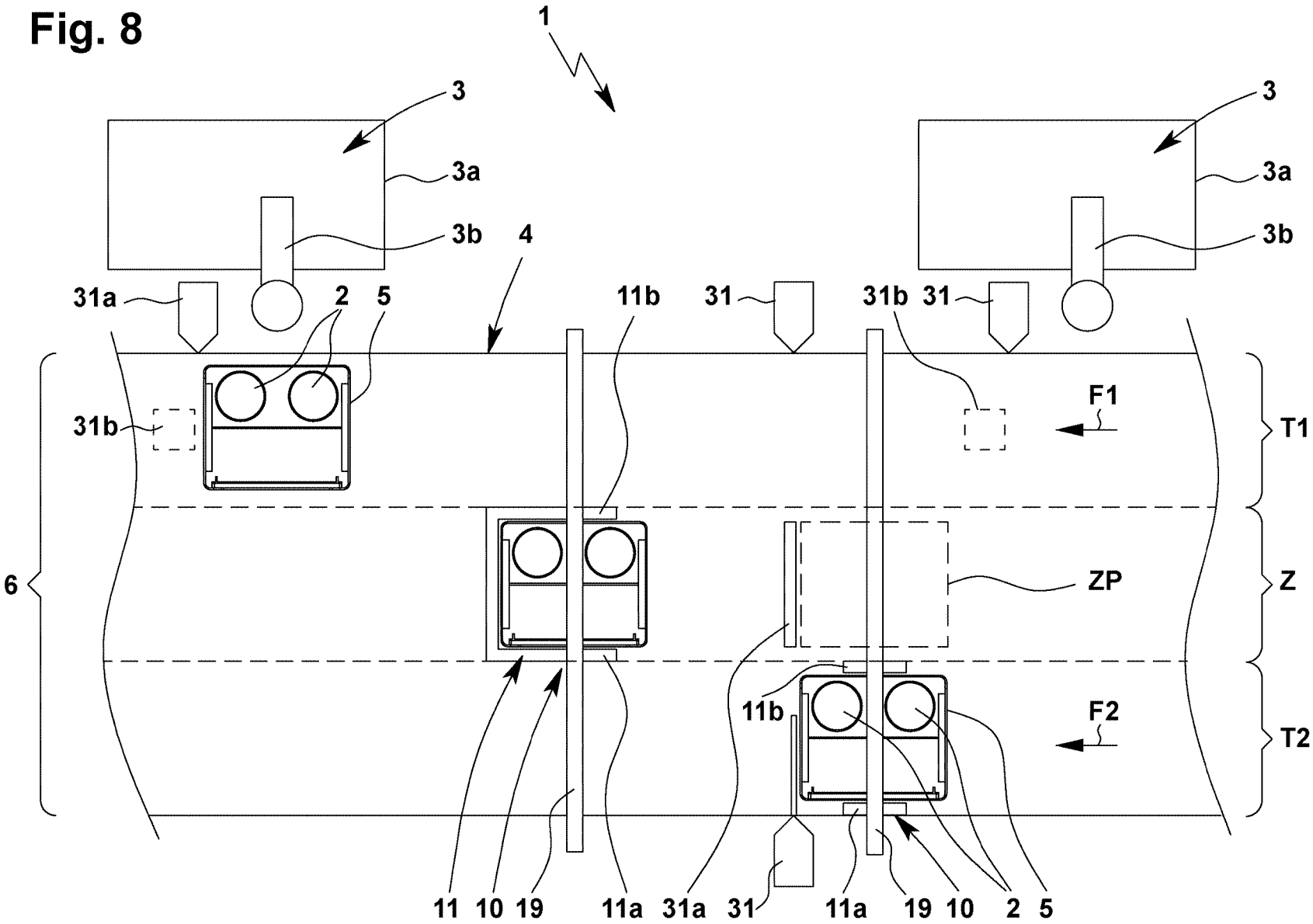
FIG. 8 a schematic section of a further embodiment of the installation according to the proposal in a plan view.

Preferably, several or all processing devices 3 of the installation 1 comprise their own housing 3*a* and/or their own manipulation device 3*b*, as schematically indicated in FIG. 8.

The manipulation device 3*b* serves in particular to receive a lens 2 to be processed, in particular from the respective lens carrier 5, and to transfer it to the associated processing device 3 and/or holds the lens 2 during processing. Alternatively or additionally, the manipulation device 3*b* preferably serves to deliver a processed lens 2, in particular to a corresponding or the same lens carrier 5.

The direction of conveyance of the conveyor belts 6, 6' is indicated in FIGS. 1 and 2 by an arrow F1 and F2, respectively. The direction of conveyance F1, F2 of the transport tracks T1, T2 is therefore preferably aligned with the direction of conveyance of the conveyor belts 6, 6'.

Preferably, the second conveyor belt 6' in the first illustrated embodiment of the installation 1 according to the proposal, and thus the transport track T2, convey in the same direction as the first conveyor belt 6 or the first transport track T1.

However, other constructive solutions are also possible here.

The first transport track T1 is preferably directly adjacent to the processing devices 3. In particular, the first transport track T1 serves to convey the lenses 2 or lens carriers 5 from one processing device 3 to the next or connects the processing devices 3 to one another.

According to the preceding definition of the term "directly adjacent", the processing devices 3 and the transport track T1 and/or the conveying device 4 are preferably directly adjacent to each other, in particular at least substantially without distance and/or gap.

Accordingly, the processing devices 3 can in particular be positioned directly on the conveying device 4 and/or on the transport track T1.

Therefore, a particular advantage of the installation 1 according to the proposal is that, depending on requirements, extensions of the installation 1 by additional processing devices 3 can be carried out very easily, since these only have to be pushed up to the conveying device 4 and/or the first transport track T1.

The second, at least essentially parallel, transport track T2 is used for conveying, in particular in parallel and/or for further transport of the respective ophthalmic lenses 2 or lens carriers 5. In particular, the second transport track T2 serves as a passing track on which the ophthalmic lenses 2 and/or lens carriers 5, which are not to be fed to a processing device 3, are further transported.

Preferably, a distance is provided between the, in particular separate, conveyor belts 6, 6' in such a way that an intermediate space is created between the conveyor belts 6, 6'. This has the advantage that various components, in particular stop devices 31 and/or measuring devices such sensors 32, can be accommodated.

FIG. 1 shows several stop devices 31 in the form of separations. These serve in particular to stop a lens carrier 5 as required while the conveyor belts 6, 6' are running. The lens carriers 5 are stopped in particular in order to position the lens carriers 5 individually at the appropriate points on the conveying device 4—for example on the first transport track T1 in the area of the processing devices 3 or in front of them, in particular for loading and unloading the processing devices 3 with ophthalmic lenses 2, and/or on both transport tracks T1 and T2, in particular in front of or at a pushing device 10.

Preferably, the stopping devices 31 are located in front of the respective pushing devices with respect to the direction of conveyance F1, F2, preferably at a distance from the pushing device 10 and/or from each other, in particular of at least one length of the lens carrier 5.

Furthermore, stopping devices 31 are provided in the holding area of the processing devices 3, which are in particular spaced apart from each other in such a way that the loading and unloading of the lens carriers 5, in particular with ophthalmic lenses 2, can be performed particularly reliably.

The installation 1 according to the proposal preferably comprises sensors 32, such as light scanners, in particular for detecting the presence and/or the position of lenses 2 and/or lens carriers 5, and/or barcode readers, in particular for identifying ophthalmic lenses 2 and/or lens carriers 5.

In the example shown, the conveyor belts 6, 6', which in particular each form a transport track T1, T2, are driven in particular by a common drive system 7 (FIG. 2), preferably in such a way that the two conveyor belts 6, 6' or the transport tracks T1, T2 convey or circulate in the same direction F1, F2, in particular at the same speed. In a particularly preferred embodiment, this is achieved by a drive shaft connecting the two conveyor belts 6, 6'.

A further variant of the conveying device 4 of the installation 1 according to the proposal provides that the two conveyor belts 6, 6' of the conveying device 4 are driven by two separate drive systems 7 or preferably by a common drive system 7 with planetary gear. In particular, this allows variations in the conveyor or circulation speed of the conveyor belts 6, 6' or the transport tracks T1, T2.

For example, it is conceivable to select a higher speed for the conveyor belt 6' and thus for the transport track T2 than for the conveyor belt 6 and/or the transport track T1 in order to avoid a buildup of lens carriers 5 and/or to enable a higher throughput when there is a high volume of lens carriers 5.

Opposite directions of conveyance F1 and F2 are also conceivable in such an embodiment with separate drives 7 or a corresponding gear coupling.

According to another embodiment, as shown in FIG. 8, the conveying device 4 of the installation 1 according to the proposal can also comprise (only) one conveyor belt 6, which is divided into two separate areas, i.e. two transport tracks T1 and T2, and a drive system 7.

Preferably, the conveying device 4 of the installation 1 according to the proposal comprises guide bars 8, in particular arranged at the edges of the conveyor belts 6, 6', as indicated in FIG. 1. Particularly preferably, each conveyor belt 6, 6' is bounded by two guide bars 8.

The guide bars 8 enable the lenses 2 and/or lens carriers 5 to be guided along the transport tracks T1, T2, in particular parallel to the directions of conveyance F1 and F2, in particular in at least a substantially straight line.

As can further be seen from FIG. 1, the installation 1 according to the proposal comprises in particular one or more pushing devices 10 as transfer devices for changing the transport tracks T1, T2.

The pushing devices 10 are preferably arranged between the processing devices 3. Preferably, pushing devices 10 are arranged between all adjacent processing devices 3. However, embodiments are also possible in which pushing devices 10 are not arranged between all processing devices 3, but only before or after some of them. Optionally, the pushing devices 10 can also be assigned to a processing device 3, in particular directly or indirectly adjacent to a processing device 3.

In the illustration example, the processing devices 3, in relation to the direction of conveyance F1, F2, are preferably arranged one behind the other, in particular in a row, especially preferably on a common side of the conveying device 4 and/or a conveyor belt 6, 6'.

The pushing devices 10 preferably serve to transport and/or change the lenses 2 and/or lens carriers 5, in particular as required, from one transport track T1, T2 to the other and/or from one conveyor belt 6, 6' to the other, in particular transversely to the direction of conveyance F1, F2.

The transverse conveying can take place in both directions R1, R2 transverse to the direction of conveyance F1, F2. In the example shown, transverse conveying can take place in the transverse direction R1 from the first transport track T1 and/or the first conveyor belt 6 to the second transport track T2 and/or the second conveyor belt 6' and vice versa in the direction R2 from the second transport track T2 and/or the second conveyor belt 6' to the first transport track T1 and/or the first conveyor belt 6.

For simplicity, the transverse directions R1, R2 in FIG. 1 are shown perpendicular and/or at a right angle relative to the direction of conveyance F1, F2. However, as mentioned above, the transverse conveyance can also take place at any other angles, in particular diagonally, with respect to the direction of conveyance F1, F2.

Further, the pushing devices 10 are preferably designed to receive and temporarily store the ophthalmic lenses 2 and/or lens carriers 5 as needed.

Preferably, the installation 1 or pushing device 10 according to the proposal comprises an intermediate position ZP (FIG. 8) or intermediate plate 9, (FIG. 1), in particular in the area of the pushing devices 10 between the transport tracks T1, T2 and/or conveyor belts 6, 6'. The intermediate position ZP represents in particular a parking or waiting area for a lens carrier 5 and can optionally be formed by the intermediate plate 9. The intermediate plate 9 serves in particular to bridge the distance between the conveyor belts 6, 6', in particular during transverse conveying of the ophthalmic lenses 2 or lens carriers 5 by means of the pushing device 10 from one conveyor belt 6, 6' to the other.

Furthermore, in the area of the pushing devices 10, in particular in the area of the intermediate plate 9, recesses and/or openings of the guide bars 8 are preferably provided, (see FIGS. 1, 3, 5 and 6), in particular to enable transverse conveying of the lenses 2 and/or lens carrier 5 without stroke.

Figure 3:
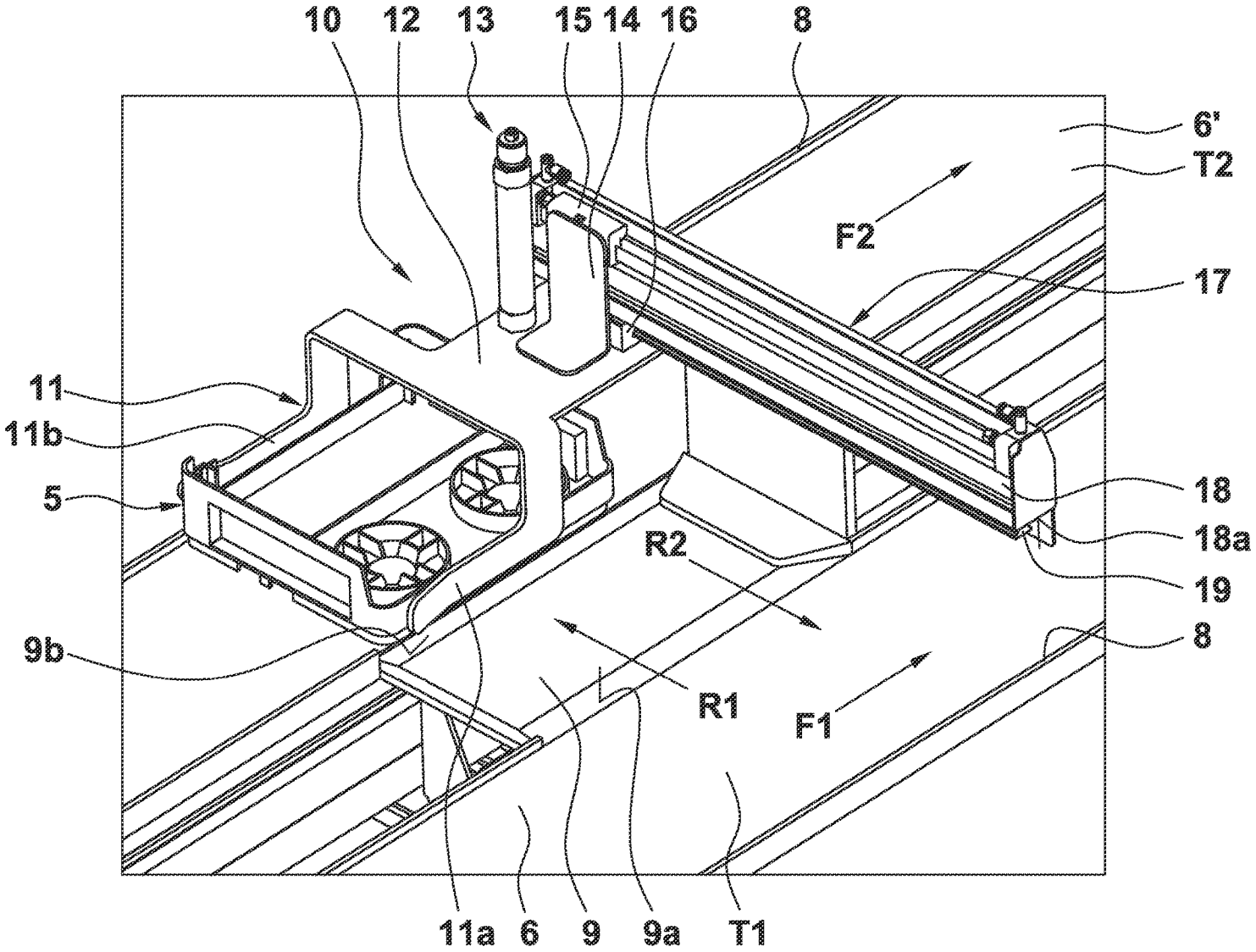
FIG. 3 a perspective view of a first embodiment of the pushing device of the proposed installation according to FIG. 1.

Particularly preferably, the intermediate plate 9, as can be seen in the perspective view according to FIG. 3, is (somewhat) higher than the conveyor belts 6, 6' themselves and/or comprises, in particular, bevels 9*a*, 9*b* on the edges facing the conveyor belts 6, 6'. These serve in particular to convey the lens carrier 5 up onto the intermediate plate 9, preferably without having to lift the lens carrier 5. The higher level of the intermediate plate 9 in relation to the conveyor belts 6, 6' again serves in particular to ensure that the lens carrier 5 does not get caught on the edge of the respective conveyor belt 6, 6' when being conveyed from the intermediate plate 9 onto a conveyor belt 6, 6' or a transport track T1, T2.

The transport/change and/or the transverse transport of the ophthalmic lenses 2 and/or lens carriers 5 by the pushing devices 10 can take place on the one hand from one conveyor belt 6, 6' to the other, in particular independently of the number of transport tracks on a conveyor belt. The transverse displacement can take place both between two spaced conveyor belts 6, 6', which are connected to each other in particular by an intermediate plate 9, and between two conveyor belts 6, 6', which are directly adjacent to each other and/or are not spaced from each other.

Alternatively, transverse conveying of the ophthalmic lenses 2 and/or lens carriers 5 by the pushing devices 10 can also take place between several transport tracks T1, T2 on a common conveyor belt 6, 6'.

As can be seen in FIG. 3, the pushing device 10 preferably comprises a guide device, in particular in the form of a fork 11 and/or with two side elements 11*a*, 11*b*. In the illustrative example, the side elements 11*a*, 11*b* are connected, preferably integrally, to a holder or holding surface 12.

The side elements 11*a* and 11*b* preferably comprise inlet bevels at their free ends so that a lens carrier 5 is securely received between the side elements 11*a*, 11*b*.

In the example shown, the pushing device 10 preferably comprises a stopper 13, in particular a vertical stopper 13, which is recessed into or integrated into or attached to the holder or holding surface 12. Particularly preferably, the stopper 13 is designed as a pneumatic cylinder.

Figure 4:
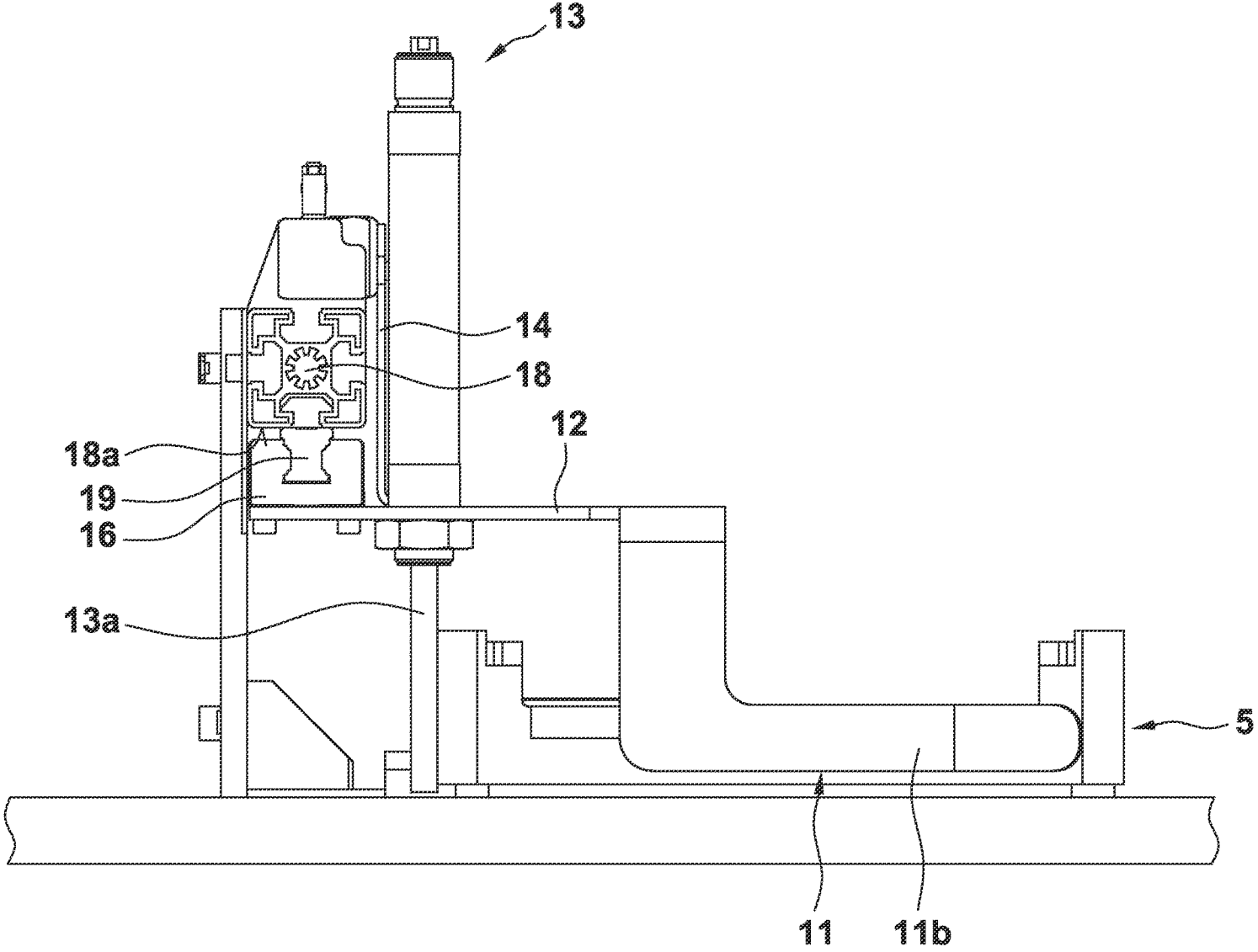
FIG. 4 a side view of the pushing device according to FIG. 3.

The stopper 13 is preferably provided for stopping and/or halting the lens carrier 5, in particular when the conveyor belt 6, 6' is running. As can be seen in particular from the side view according to FIG. 4, the stopper 13 in the illustrated example comprises an extendable piston 13*a*. If the piston 13*a* is extended downward toward the conveyor belts 6, 6', the lens carrier 5 is stopped by the piston 13*a* while the conveyor belts 6, 6' are running or comes to rest against the piston 13*a*. When the piston 13*a* is in the retracted state, the lens carrier 5 can continue to run on the conveying device 4 or the conveyor belts 6, 6'.

The guide device or fork 11 is preferably movable or displaceable transversely via a lens guide or rail 19 and a carriage, in this case horizontally in the transverse direction R1, R2.

FIG. 3 also shows that the holder and/or holding surface 12 and/or the fork 11 is connected, in particular via a mounting bracket 14, to a linear drive, for example via a driver 15, preferably in the form of a carriage.

The driver 15 or carriage and/or linear operation serves in particular for a driving and/or linear movement of the guide device and/or fork 11 and thus for the transverse conveying of the lens carrier 5 from one transport track T1, T2 to the other.

Preferably, the driver 15 is arranged to be linearly movable, in particular on a transfer cylinder 17.

The transfer cylinder 17 is preferably designed as a linear drive, in particular as a pneumatic cylinder.

In the example shown, the transfer cylinder 17 is mounted on a carrier 18. Preferably, a guide or rail 19, which is preferably designed as a linear guide, is attached and/or mounted on one longitudinal side, in particular on the bottom side 18*a*, of the carrier 18.

The guide device and/or fork 11 is preferably movable and/or positionable along the guide and/or rail 19, in particular linearly, in particular by means of a slide 16 guided displaceably thereon.

In the example shown, the transverse movement of the guide device and/or fork 11 is performed in particular by the linear drive of the transfer cylinder 17.

The, in particular linear, displacement and/or movement of the guide device and/or the slide 16 along the guide and/or rail 19 enables particularly reliable or targeted transverse conveyance of the lens carrier 5. The two linear guide components, i.e. the transfer cylinder 17 on the one hand and the guide and/or rail 19 on the other hand, ensure particularly stable transverse conveyance.

According to another aspect of the present invention, which can also be implemented independently, the following process can be carried out with the pushing device 10 in combination with the conveying device 4 of the installation 1 according to the proposal:

As soon as a lens carrier 5 moves into the guide device, the lens carrier 5 is stopped by the stopper 13 and/or the lowered piston 13*a*. For transverse conveying of the lens carrier 5 from one transport track T1, T2 to the other and/or from one conveyor belt 6, 6' to the other, the guide device and/or the fork 11 is transported by means of the transfer cylinder 17 and in particular the supporting linear guide along the guide and/or rail 19 via the intermediate plate 9 from one transport track T1, T2 to the other and/or from one conveyor belt 6, 6' to the other, the lens carrier 5 being carried along between the side elements 11*a*, 11*b* of the guide device and/or the fork 11. When the lens carrier 5 is to be conveyed further on a transport track T1, T2 in the direction of conveyance F1, F2, the stopper 13 and/or the piston 13*a* moves up in such a way that the lens carrier 5 can pass through the guide device and/or the fork 11 on the moving conveyor belt 6, 6'. This is made possible in particular by the fact that no lateral clamping forces act on the lens carrier 5 from the side elements 11*a*, 11*b*.

Optionally, the lens carrier 5 can also pass directly through the guide device and/or the fork 11 while the conveyor belt 6, 6' is running, i.e. without the lens carrier 5 being conveyed transversely from one transport track T1, T2 to the other. This is provided, for example, if a lens carrier 5 conveyed on the second transport track T2 is not to be processed at the processing device 3 closest in relation to the direction of conveyance F1, F2, but only at a subsequent processing device 3.

The pushing device 10 and/or its guide device or fork 11 is particularly preferably designed in such a way that the lens carrier 5 is pushed or pulled to change the transport track T1, T2 and/or to move into an intermediate position ZP and/or an intermediate area Z between the transport tracks T1, T2 and/or from the intermediate position ZP and/or the intermediate area Z into a transport track T1 or T2.

The movement is thus preferably performed exclusively by primarily lateral force action, in particular without active lifting of the lens carrier 5 by the pushing device 10 and/or its guide device or fork 11.

Particularly preferably, the pushing device 10 and/or its guide device or fork 11 is designed in such a way that the lens carrier 5 is guided or limited in its movement both in the direction of conveyance F1, F2 and transversely thereto—i.e. in particular laterally—in order to be able to move and/or displace the lens carrier 5 safely and quickly and/or in a defined manner in the transverse direction, in particular without the lens carrier 5 being able to twist or tilt or even turn in the horizontal plane. In this context, it should be noted that the pushing device 10 and/or its guide device or fork 11 provides a certain, preferably small lateral play—here particularly preferably between the side elements 11*a* and 11*b*—with respect to the lens carrier 5.

Alternatively or additionally, the side elements 11*a* and 11*b* can optionally also be adjustable relative to each other, for example to adapt to different lens carrier widths.

Alternatively or additionally, the guide device or fork 11 can also be rotatable, in particular about a vertical axis, for example to be able to rotate the lens carrier 5, for example by 90° or 180° in the horizontal plane for a subsequently different direction of conveyance, if required.

In particular, the pushing device 10 and/or its guide device or fork 11 can thus guide the lens carrier 5 on one or both sides (parallel to the direction of conveyance F1, F2 or transport track T1, T2) as well as on a side leading in the direction of conveyance F1 and/or F2 and/or limit its movement, so that in particular with the conveyor belt 6 or 6' running further in the direction of conveyance F1 and/or F2, the desired transverse displacement of the lens carrier 5 can be effected as required by corresponding transverse movement of the pushing device 10 and/or its guide device or fork 11.

The preferred two-sided or three-sided guidance of the lens carrier 5 (in the illustrated example on the sides by the side elements 11*a* and 11*b* and on the leading side by the stopper 13 by the pushing device 10 or its guide device or fork 11) can alternatively also be achieved by a corresponding engagement or overlap. For example, the pushing device 10 and 7 or its guide device or fork 11 can engage over the leading side wall after a lens carrier 5 has stopped and thereby guide or secure the lens carrier 5 accordingly, in particular for the subsequent transverse movement. Various other design solutions are also possible here.

It should also be noted that for moving the lens carrier 5 in a transverse direction R1 or R2, a two-sided guide, namely on a side running in the direction of conveyance F1, F2 and on a side running transversely and/or perpendicularly thereto, is sufficient, and the pushing device 10 and/or its guide element can accordingly optionally also be designed with only one side element 11*a* or 11*b* or act on the lens carrier 5 for transverse conveyance in one direction.

In the embodiment described, the guide device and/or fork 11 of the pushing device 10 is preferably movable only horizontally and/or transversely and only a stopper 13 or piston 13*a* movable vertically or in some other way (for example, by pivoting) is provided. However, other design solutions are also possible. For example, the guide device and/or fork 11 can optionally also be movable or liftable vertically as a whole, as explained below with reference to a further embodiment. In this case, the movability of the stopper 13 can be omitted.

Figure 5:
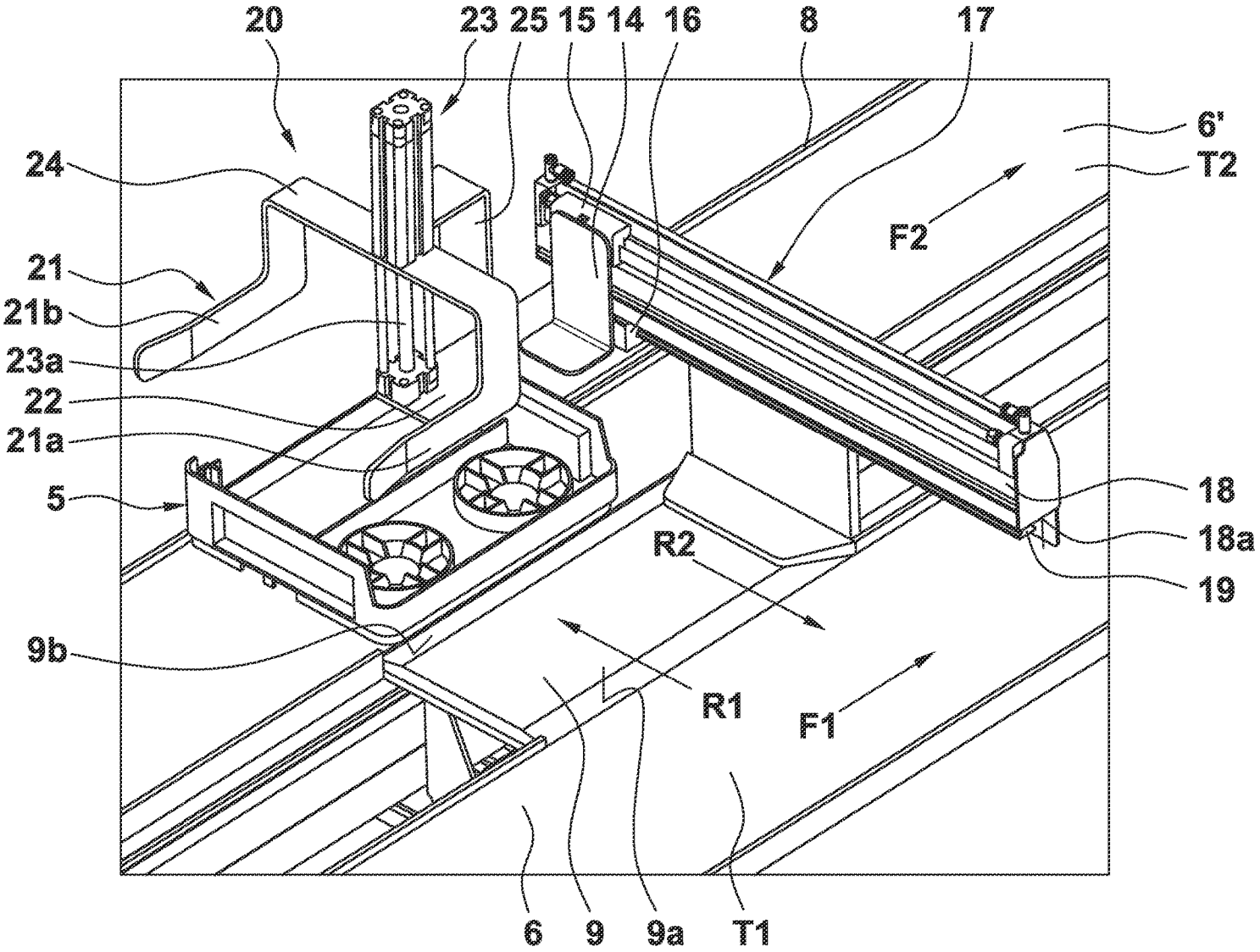
FIG. 5 a perspective view of a second embodiment of the pushing device.
Figure 6:
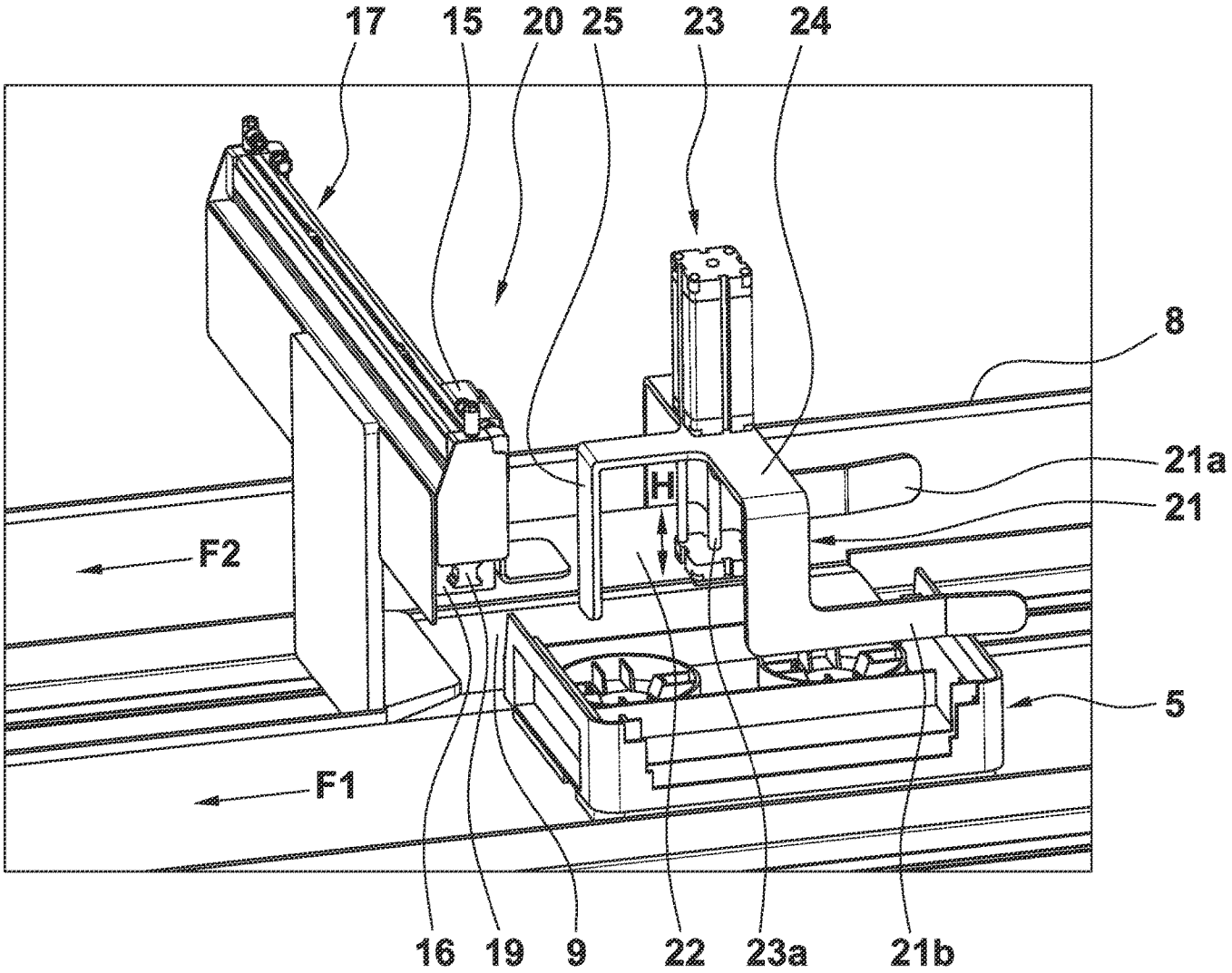
FIG. 6 the pushing device according to FIG. 5 in another perspective.

With reference to FIGS. 5 and 6, an alternative embodiment of the pushing device, hereinafter referred to as pushing device 20, is explained in more detail.

The pushing device 20 preferably comprises a guide device and/or a fork 21, in particular with two side elements 21*a*, 21*b*.

According to a particularly preferred aspect of the present invention, which can also be implemented independently, the guide device or fork 21 of the pushing device 20 is adjustable in height or vertically, in particular along the arrow H, particularly preferably by means of a lifting cylinder 23.

In the illustrated example, the side elements 21*a*, 21*b* are connected, preferably integrally, to an (upper) mounting and/or holding surface 24. In the illustrated example, the pushing device 20 comprises a vertical lifting cylinder 23, preferably a pneumatic cylinder, in particular recessed in and/or coupled to the (upper) holder and/or holding surface 24, the lower end of which is preferably attached to the lower holding surface 22.

Preferably, the lifting cylinder 23 is adjustable and/or displaceable in height, in particular by means of a piston 23*a*, in particular along the arrow H. The vertical displacement of the lifting cylinder 23 along the arrow H causes the fork 21 to be displaced in height, in particular via the upper holding surface 24.

In the illustrated embodiment, the fork 21 is in the raised state. In this state, the lens carrier 5 can pass under the fork 21 while the conveyor belt 6, 6' is running.

As can be seen from FIG. 6, a stop element, in particular a substantially vertical holding arm 25, is preferably used to stop the lens carriers 5 on the, in particular circulating, conveyor belts 6, 6'.

If the guide device is in its lower position, the lens carrier 5 is stopped by the holding arm 25 when the conveyor belts 6, 6' are running, while the lens carrier 5 continues to be conveyed by the conveyor device 4 or the conveyor belts 6, 6' when the guide device is raised.

The transverse conveying of the ophthalmic lenses 2 and/or lens carriers 5 takes place in the case of the pushing device 20 in an identical manner as in the case of the pushing device 10 (see above), i.e. by linear movement or a linear guide and/or a linear drive.

A particular advantage of the pushing device 20 and/or, in particular, of the preferably height-adjustable guide device and/or fork 21 of the pushing device 20 is that the lens carrier 5 can leave the pushing device 20 more quickly and/or be carried along with the conveyor belt 6, 6' by a rapid raising of the fork 21. This can prevent a jam of lens carriers 5 and/or achieve a higher throughput. For transverse conveying of the ophthalmic lenses 2 and/or lens carriers 5 from one transport track T1, T2 to the other, the fork 21 with the lens carrier 5 always remains on the conveyor belt 6, 6' or the intermediate plate 9.

The guide device and/or fork 11, 21 of the pushing device 10, 20 is preferably wider than the lens carrier 5, in particular in order to ensure a substantially resistance-free driving of the lens carrier 5 into and/or through the fork 11, 21. The width of the fork 11, 21 is advantageously selected in particular so that the lens carrier 5 can be pushed particularly reliably, in particular with little play, from one transport track T1, T2 to the other and/or from one conveyor belt 6, 6' to the other when it is carried along and/or conveyed transversely by the fork 11, 21.

Figure 7:
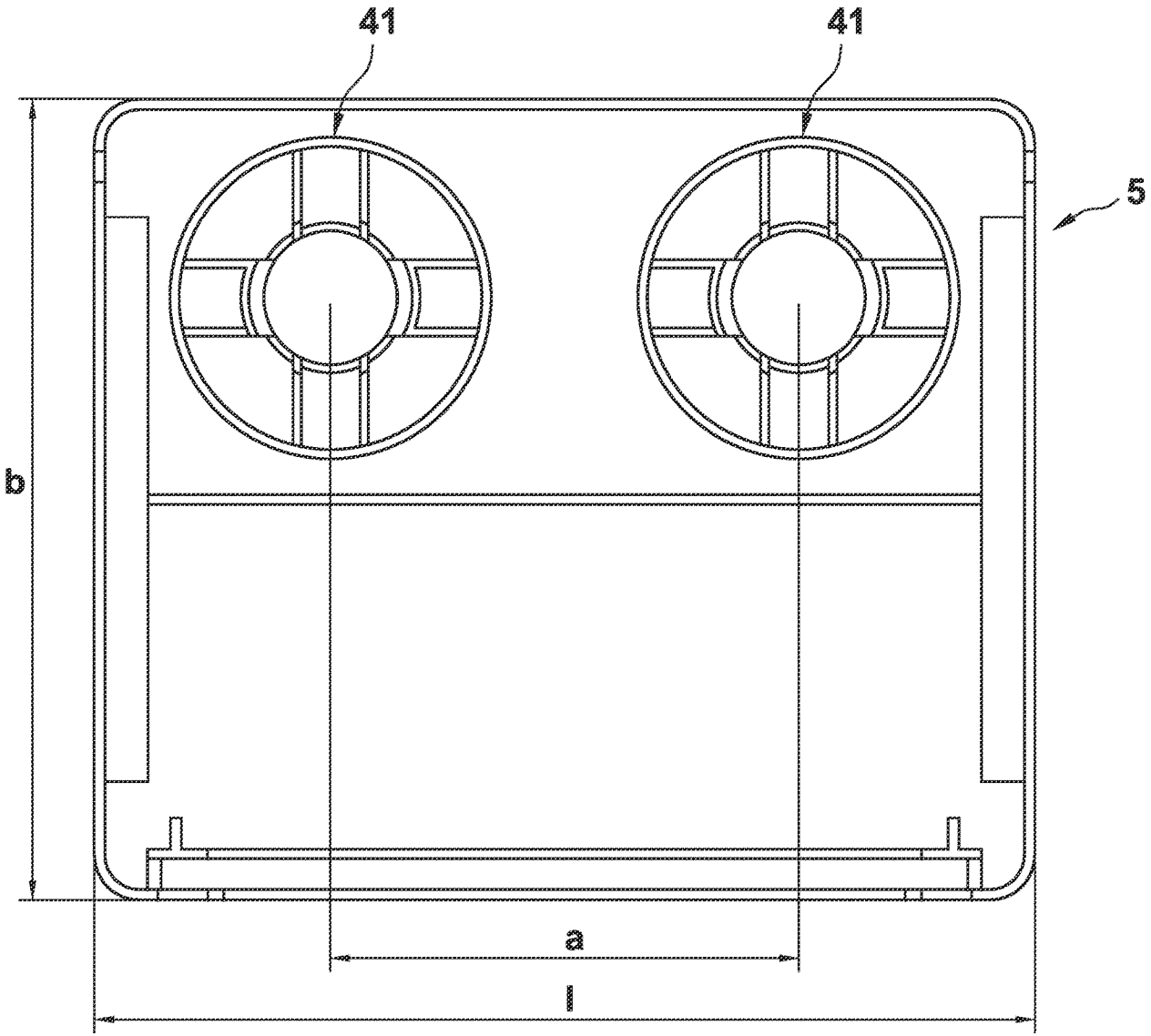
FIG. 7 a schematic representation of a lens carrier in a top view.

FIG. 7 shows a schematic top view of a preferred embodiment of a lens carrier 5 for accommodating at least one ophthalmic lens 2, in particular two in the example shown.

Preferably, two ophthalmic lenses 2 and/or a pair of lenses to be processed are accommodated by a lens carrier 5, as is common in lens or ophthalmic lens production.

The lens carrier 5 preferably comprises two receiving sites 41, in particular for receiving ophthalmic lenses 2. The receiving places are in particular designed in such a way that slipping of the ophthalmic lenses 2 can be avoided, in particular during conveying and/or stopping of the lens carrier 5. In particular, this allows the ophthalmic lenses 2 to remain particularly stable in their spatial position on the lens carrier 5 and therefore loading and unloading, in particular in the holding area of the processing devices 3, can be carried out particularly reliably.

Preferably, the distance between the ophthalmic lenses 2 and/or the receiving sites 41 within a lens carrier 5 in the illustration example is at least substantially the same as the distance between an ophthalmic lens 2 and/or a receiving site 41 in a lens carrier 5 and the adjacent ophthalmic lens 2 and/or the adjacent receiving site 41 in a directly adjacent lens carrier 5. This simplifies the handling and/or positioning of the ophthalmic lenses 2, in particular on the transport track T1 at the processing devices 3 for loading and unloading the processing devices 3 with ophthalmic lenses 2.

The distance a between the centers of the receiving sites 41 of the lens carrier 5 in the illustrated embodiment is approx. 130 mm with an error tolerance of 10 mm. The length 1 of the lens carrier 5 is preferably twice the distance a, i.e. approx. 260 mm with an error tolerance of 10 mm. The width b of the lens carrier 5 is preferably approx. 220 mm with an error tolerance of 10 mm.

A further aspect of the present invention, which can also be implemented independently, is that the width of the conveying device 4 and/or of the conveyor belts 6, 6' is preferably determined by the width of the lens carrier 5, in particular by the number of transport tracks.

Preferably, the width of a transport track T1, T2 corresponds at least to the width b of a lens carrier 5.

Furthermore, the width of the conveyor belts 6, 6' preferably corresponds in each case to the number of transport tracks per conveyor belt. In other words, the width of a conveyor belt preferably corresponds to at least the number of transport tracks multiplied by the width b of the lens carrier 5.

In the embodiment example, the width of the conveyor belts 6, 6' is in each case at least the width b of a lens carrier 5, i.e. at least approx. 220 mm, taking into account the error tolerance.

The width of the conveying device 4 is preferably at least equal to the number of transport tracks multiplied by the width b of the lens carrier 5.

In the case of several, i.e. at least two conveyor belts 6, 6', the width of the conveying device 4 preferably corresponds to at least the number of conveyor belts 6, 6' multiplied by the width b of the lens carrier 5, i.e. preferably at least the multiple of approx. 220 mm, taking into account the error tolerance.

In the case of mutually spaced conveyor belts 6, 6', the width of the conveying device 4 preferably corresponds to at least the number of transport tracks T1, T2 multiplied by the width b of the lens carrier 5, in particular plus the distance between the conveyor belts 6, 6'.

According to the proposal, the width of the conveying device 4 is preferably at least twice the width b of the lens carrier 5, i.e. at least approx. 440 mm in the illustrated embodiment, taking into account the error tolerance, in particular plus the distance between the conveyor belts 6, 6'.

In the case of the embodiment with two transport tracks T1, T2 on a common conveyor belt 6, the width of the conveyor belt 6 corresponds to the width of the conveying device 4 and is preferably at least twice the width of the lens carrier 5.

In addition to the aforementioned embodiment example of the lens carrier 5, narrower variants of the lens carrier 5 are also conceivable, which are generally known to the skilled person. These can have, for example, a length l of between 245 and 265 mm, in particular approx. 250 mm, a width b of between 120 and 130 mm, in particular approx. 125 mm, and/or a distance a between the receiving sites 41 of between 110 and 135 mm, in particular approx. 130 mm. Other dimensions are of course also conceivable.

Furthermore, known per se, in particular stackable embodiments, for example double trays, of the lens carriers 5 can be used. In the case of lens carriers 5 stacked one on top of the other, it is useful to take their height into account. This is possible, for example, by raising or lowering the conveying device 4 or the processing devices 3 by the respective height of the additional lens carrier 5.

FIG. 8 shows in a sectional, schematic plan view a further embodiment of the installation 1 according to the proposal, as already mentioned. In the following, in particular essential differences compared to the already described embodiments and variants are explained, whereby the previous explanations and explanations apply in particular accordingly or supplementarily, even if a repeated description is omitted.

In the embodiment according to FIG. 8, the (common) conveyor belt 6 preferably forms both transport tracks T1, T2, i.e. the first transport track T1 and the second transport track T2.

The conveying device 4 and/or the conveyor belt 6 preferably comprises an intermediate area Z between the two transport tracks T1, T2 in order to be able to park the lens carrier 5 in an intermediate position ZP between the two transport tracks T1 and T2, if necessary.

Instead of one conveyor belt 6 forming the two transport tracks T1, T2 and the intermediate area Z, several correspondingly coupled conveyor belts 6 can also be used for this purpose.

The installation 1 and/or the conveying device 4 preferably again comprises stopping devices 31, 31*a*, 31*b* in order to be able to stop the lens carrier 5 as required at desired points on the conveying device 4 and/or the conveyor belt 6 and/or on the transport tracks T1 and T2, in particular in front of the processing devices 3 and/or in front of and/or at the pushing devices 10 and/or in the intermediate area Z or at the intermediate positions ZP—in particular also when the conveyor belt 6 continues to run.

The stopping devices 31 can, for example, be arranged laterally on the conveyor belt 6 and/or laterally on the outside of the transport tracks T1 and/or T2.

The stop devices 31 can, for example, also stop or halt a lens carrier 5 in the intermediate area Z as required and, if arranged laterally, can be designed, for example, in the form of a bridge in order to be able to act accordingly in the intermediate area Z. However, other design solutions are also possible. For example, the stopping devices 31 can also be arranged only in the intermediate region Z or above it, as indicated by the reference signs 31*a* as an example. In this case, the stop devices 31*a* can also be stationary and/or fixed or, alternatively, can be moved away from the path of movement in order to allow the lens carriers 5 to be conveyed further in the intermediate area Z, i.e. to form an additional transport track between the two transport tracks T1 and T2.

Alternatively or additionally, stop devices 31 can also be provided in the region of the transport tracks T1, T2, in particular in the region of the first transport track T1, which are arranged primarily or exclusively above the conveyor belt 6 and/or the respective transport track T1 and/or T2, in particular in order to be able to position the processing devices 3 as close as possible to the conveyor belt 6 and/or the first transport track T1, without the stop device 31 having to be arranged between the processing device 3 and the conveyor belt 6 and/or the first transport track T1. These stop devices 31*b* are then preferably movable out of the path of movement, for example by linear movement and/or pivoting, in order to release a conveyance of the lens carriers 5 on the corresponding transport track, in this case the first transport track T1, in the direction of conveyance F1, as required, or to selectively stop the lens carriers 5, in particular in front of the respective processing device 3.

Optionally, a pushing device 10 can also cooperate with associated stopping devices 31, 31*a*, 31*b*. In this case, the stopping devices 31 can also form part of the pushing device and/or part of the guide device of the pushing device 10. This is indicated by way of example in FIG. 8 for the right pushing device 10.

In the illustrated example, the lens carrier 5 is located on the second transport track T2 on the pushing device 10 and is held and/or stopped in the direction of conveyance F2 by the stop device 31 associated with the second transport track T2. Thus, the stopping device 31 guides the lens carrier 5 in the direction of conveyance F2 when the lens carrier 5 is displaced transversely by the pushing device 10.

In this case, the right-hand pushing device 10 guides the lens carrier 5 laterally via its guide device, in this case the side elements 11*a* and 11*b*, so that safe and defined guidance of the lens carrier 5 takes place during transverse displacement.

In the optional intermediate area Z, the preferably stationary stop device 31*a* is then connected in the illustration example in order to hold the lens carrier 5 back against further conveyance in the direction of conveyance F1, F2 when the conveyor belt 6 continues to run, and/or to guide it on its leading side during transverse conveyance.

Finally, during further displacement to the first transport track T1, the oppositely arranged stopping device 31 can then, if necessary, hold and guide the lens carrier 5 again in the direction of conveyance F1, so that in the illustrated example the right-hand pushing device 10 also enables and/or ensures safe guidance of the lens carrier 5 during transverse displacement both in the direction of conveyance F1 and in the lateral direction through interaction with the stopping devices 31, 31*a*.

However, other constructive solutions are also possible.

In the pushing device 10 on the left in FIG. 8, it is indicated that its guide device or fork 11, which is in particular U-shaped, does not require a stop device 31 or 31*a*. In this case, the guide device and/or fork 11 can preferably be raised vertically in order to be able to release the lens carrier 5 again for further conveying, as already described by way of example for the pushing device 20 with reference to FIGS. 5 and 6.

Individual aspects and features of the various embodiments and variants can also be combined with one another as desired, but can also be implemented independently of one another.

The guide device and/or fork 11, 21 of the pushing device 10, 20 is preferably U-shaped and/or rigid.

The side elements 11*a*, 11*b* and/or 21*a*, 21*b* can optionally be adjustable—in particular manually or by motor—and/or widened at their free ends to form inlet slopes (as indicated in particular in FIG. 5) for the lens carrier 5 to be accommodated.

In general, it should be noted that the installation 1 and/or conveying device 4 preferably forms or comprises a continuous first transport track T1 in front of the processing devices 3, the processing devices 3 each comprising their own manipulation device 3*b* for receiving lenses 2 from the first transport track T1 for processing and for delivering them back to it after processing in particular.

The pushing device 10, 20 is preferably designed to push or pull the respective lens carrier 5 transversely to the direction of conveyance F1, F2, in particular from one transport track T1, T2 to the other, and in so doing to guide the lens carrier 5 both in the direction of conveyance F1, F2 and transversely thereto.

The lens carriers 5 are preferably pushed or pulled by the pushing device 10, 20 during the transverse direction R1, R2 exclusively by primarily lateral force action without active lifting.

The lenses 2 are preferably conveyed to and/or away from the processing devices 3 via lens carriers 5.

The processing devices 3 particularly preferably process the lenses 2 only in the order in which the lenses 2 and/or lens carriers 5 are fed, in particular only via the first transport track T1.

However, it is also possible that a processing device 3 and/or the conveying device 4 does not stop a lens carrier 5 arriving on the first transport track T1 before the processing device 3, but allows it to continue moving in the direction of conveyance F1. This is possible, for example, in order to realize an optimized sequence, or is necessary, for example, if the processing device 3 has failed.

It is also an aspect of the present invention that the pushing device 10, 20 is used for processing ophthalmic lenses 2 in order to change lens carriers 5 between transport tracks T1, T2 and an optional intermediate area Z in a simple manner, quickly and safely.

In particular, the present invention relates also to any one of the following aspects which can be realized independently or in any combination, also in combination with any aspects described above or in the claims:

1. Installation 1 for processing ophthalmic lenses 2, in particular for spectacles, with several, in particular separate, processing devices 3 for independent processing of the ophthalmic lenses 2, with a conveyor device 4 connecting the processing devices 3 to each other for transporting the ophthalmic lenses 2 and/or lens carriers 5 to and from the processing device 3, wherein the conveying device 4 comprises at least two transport tracks T1, T2, wherein a first transport track T1 serves for the transport of the ophthalmic lenses 2 and/or lens carriers 5 from one processing device 3 to the next and a second, in particular parallel, transport track T2 serves for the parallel transport of the ophthalmic lenses 2 and/or lens carriers 5;

with transfer devices for transporting, as required, the ophthalmic lenses 2 and/or lens carrier 5 from one transport track T1, T2 to the other transversely to the direction of conveyance F1, F2, for temporary pick-up/intermediate storage as required, as well as for further conveyance of the ophthalmic lenses 2 and/or lens carriers 5 as required, characterized in that the conveying device 4 comprises at least one continuous conveyor belt 6, that at least one drive system 7 is provided for the at least one conveyor belt 6, that each processing device 3 is directly adjacent to the first transport track T1, that each transfer device is designed as a pushing device 10, 20 which pushes the ophthalmic lenses 2 and/or lens carriers 5 transversely to the direction of conveyance F1, F2 from one transport track T1, T2 to the other.

2. Installation 1 according to aspect 1, characterized in that the pushing device 10, 20 comprises a fork 11, 21 movable transversely to the conveying device 4 and/or transversely to the direction of conveyance F1, F2.
3. Installation 1 according to one of the preceding aspects, characterized in that the pushing device 10, 20 comprises a linear drive for transverse conveying of the fork 11, 21.
4. Installation 1 according to one of the preceding aspects, characterized in that the fork 11, 21 of the pushing device 10, 20 can be moved in both directions R1, R2 transversely to the direction of conveyance F1, F2.
5. Installation 1 according to one of the preceding aspects, characterized in that the pushing device 10, 20 is arranged on the conveying device 4 and/or on a processing device 3.
6. Installation 1 according to one of the preceding aspects, characterized in that the conveying device 4 comprises a conveyor belt 6 with two transport tracks T1, T2 and a common drive system 7.
7. Installation 1 according to one of aspects 1 to 5, characterized in that the conveying device 4 comprises two separate conveyor belts 6, 6', each of which forms the transport tracks T1, T2.
8. Installation 1 according to aspect 7, characterized in that the conveying device 4 comprises a common drive system 7 for driving the separate conveyor belts 6, 6'.
9. Installation 1 according to aspect 7, characterized in that the conveying device 4 comprises one drive system 7, 7' per conveyor belt 6, 6'.
10. Installation 1 according to one of the preceding aspects, in particular according to one of aspects 7 to 9, characterized in that each pushing device 10, 20 is assigned an intermediate plate 9 arranged between the conveyor belts 6, 6'.
11. Installation 1 according to one of the preceding aspects, characterized in that guide bars 8, in particular for guiding the ophthalmic lenses 2 and/or lens carriers 5 parallel to the direction of conveyance F1, F2, are provided at the edges of the conveyor belts 6, 6'.
12. Installation 1 according to aspect 11, characterized in that recesses of the guide bars 8 are provided in the region of the pushing devices 10, 20 and/or in the region of the intermediate plate 9.
13. Use of a pushing device 10, 20 for transversely conveying a lens carrier 5 during the processing of ophthalmic lenses 2, wherein the lens carrier 5 is displaced transversely to the direction of conveyance F1, F2 by means of a pushing device 10, 20 in order to change a transport track T1, T2, the lens carrier 5 being guided laterally and/or in the transverse direction R1, R2 and in the direction of conveyance F1, F2 and being displaced without being actively lifted.

List of reference signs:

| | | | |
|---|---|---|---|
| 1 | Installation | 19 | Rail |
| 2 | Lens | 20 | Pushing device |
| 3 | Processing device | 21 | Fork |
| 3a | Housing | 21a | Side element |
| 3b | Manipulation device | 21b | Side element |

-continued

List of reference signs:

| | | | |
|---|---|---|---|
| 4 | Conveying device | 22 | Holding surface |
| 5 | Lens carrier | 23 | Lifting cylinder |
| 6 | Conveyor belt | 24 | upper holding surface |
| 6' | Conveyor belt | 25 | Holding arm |
| 7 | Drive system | | |
| 7' | Drive System | 31 | Stop device |
| 8 | Guide bars | 31a | Stop device |
| 9 | Intermediate plate | 31b | Stop Device |
| 9a | Bevel | 32 | Sensor |
| 9b | Bevel | | |
| 10 | Pushing device | 41 | Receiving site |
| 11 | Fork | 42 | Profile |
| 11a | Side element | | |
| 11b | Side element | F1 | Direction of conveyance |
| 12 | Holding surface | F2 | Direction of conveyance along T2 |
| 13 | Stopper | H | Arrow H |
| 13a | Piston | R1, | Transverse direction |
| 14 | Fastening bracket | R2 | Transverse direction |
| 15 | Driver | T1 | first transport track |
| 16 | Slide | T2 | second transport track |
| 17 | Transfer cylinder | Z | Intermediate rea |
| 18 | Carrier | ZP | Intermediate Position |
| 18a | Bottom side | a | Distance |
| b | Width | | |
| l | Length | | |

The invention claimed is:

1. An installation configured to process ophthalmic lenses for spectacles comprising:

several separate processing devices for independent processing of the lenses, each processing device comprising its own housing, a conveying device connecting the processing devices to one another and configured to transport lens carriers with the lenses to and from the processing devices, wherein the conveying device comprises at least two transport tracks, wherein a first transport track is configured to convey the lens carriers from one processing device to the next and a second, parallel, transport track is configured to convey the lens carriers in parallel to the first transport track;

one or more transfer devices configured to one or more of transport and change the lens carriers as required from one transport track to the other transversely to their direction of conveyance, wherein one or more of:

wherein the transfer device is configured as a pushing device, the pushing device comprises a drive that is configured to move a contact element, having a vertical or arm-like contact face, transversely to the first and second transport tracks, wherein the contact element is configured to engage with a lens carrier which pushes or pulls the respective lens carrier transversely with respect to the direction of conveyance from one transport track to the other and thereby guiding the lens carrier both in the direction of conveyance and transversely thereto, and wherein the conveying device comprises a common conveyor belt with two transport tracks and an intermediate area arranged therebetween for the lens carriers, so that a lens carrier can be positioned on the conveyor belt between the transport tracks as required, or that the conveying device comprises two conveyor belts for forming two transport tracks and an in intermediate plate arranged therebetween for the lens carriers, so that a lens carrier can be positioned as required between the transport tracks on the intermediate plate.

2. The installation according to claim 1, wherein the pushing device comprises one or more of a guide device and fork, the one or more of the guide device and fork including the contact element, which can be moved one or more of vertically and transversely to the direction of conveyance for lateral guidance of the respective lens carrier.

3. The installation according to claim 2, wherein the drive is configured to transversely move one or more of the guide device and the fork.

4. The installation according to claim 1, wherein the pushing device is configured for one or more of: hydraulic or pneumatic displacement of the lens carriers to change the transport track, and wherein the pushing device is configured for displacement of the lens carriers for changing the transport track without lifting the lens carriers.

5. The installation according to claim 1, wherein the pushing device is mounted on or comprises a guide rail that runs transversely to the first and second transport tracks.

6. The installation according to claim 1, wherein guide bars that are configured to guide the lens carriers parallel to the direction of conveyance are provided at one or more of the edges of the conveyor belts and transport tracks, wherein recesses of the guide bars are provided in one or more of the region of the pushing device, the region of the intermediate position, and intermediate plate.

7. A method to process ophthalmic lenses for vision enhancement, wherein the lenses are conveyed in lens carriers by a conveying device to separate processing devices, each processing device with own housings, wherein the conveying device forms at least two transport tracks between which the lens carriers can change of transfer devices, so that the sequence of feeding the lens carriers to the processing devices can be varied comprising:

the processing devices processing the lenses in the order in which the lens carriers are fed in, wherein one or more of:

wherein, for changing the transport track, the lens carriers are pushed or pulled with a drive that is configured to linearly move a contact element, having a vertical or arm-like contact face, transversely to the first and second transport tracks, wherein the contact element is configured to engage with a lens carrier, from one transport track to the other transport track—by the action of primarily lateral force without active lifting the lens carriers, and wherein the lens carrier is displaced transversely to the direction of conveyance by a pushing device in order to change a transport track, the lens carrier being guided laterally and/or in the transverse direction and in the direction of conveyance and being displaced without being actively lifted.

8. The method according to claim 7, for changing the transported track, the lens carriers are pushed or pulled, on a carrier that is mounted on a guide rail that runs transversely to the first and second transport track.

9. The method according to claim 7, wherein one or more of the conveying device, the continuous transport track, and the continuous transport track conveyor belt is controlled centrally and/or independently of the processing devices or vice versa.

10. The method according to claim 7, wherein that the processing devices each remove the lenses to be processed from the respective lens carrier with their own manipulation device.

11. The method according to claim 7, wherein, for changing the transport track, the lens carriers are each displaced transversely to the direction of conveyance by pusher, the lens carriers being guided one or more of laterally and in the transverse direction and in the direction of conveyance.

12. The method according to claim 7, wherein a central control or the conveying device controls stop devices for positioning the lens carriers in front of the processing devices.

13. The method according to claim 7, wherein the lens carriers are pushed or pulled hydraulically or pneumatically from one transport track to the other transport track for changing the transport track.

14. An installation configured to process ophthalmic lenses with several, separate processing devices configured to independently process the ophthalmic lenses comprising:

a conveyor device connecting the processing devices to each other for transporting one or more of the ophthalmic lenses and lens carriers to and from the processing device, wherein the conveying device comprises at least two transport tracks, wherein a first transport track serves for the transport of one or more of the ophthalmic lenses and lens carriers from one processing device to the next and a second, parallel, transport track serves for the parallel transport of one or more of the ophthalmic lenses and lens carriers;

transfer devices configured to transport one or more of the ophthalmic lenses and lens carrier from one transport track to the other transversely to the direction of conveyance, for temporary pick-up/intermediate storage as required, as well as for further conveyance of one or more of the ophthalmic lenses and lens carriers as required, wherein the conveying device comprises at least one continuous conveyor belt, wherein at least one drive system is provided for the at least one conveyor belt, wherein each processing device is directly adjacent to the first transport track, wherein at least one or each transfer device comprises a drive that is configured to move a contact element, having a vertical or arm-like contact face, transversely to the first and second transport tracks, wherein the contact element is configured to engage with a lens carrier, and is configured as a pushing device which pushes one or more of the ophthalmic lenses and lens carriers transversely to the direction of conveyance from one transport track to the other.

15. The installation according to claim 14, wherein the pushing device comprises a fork movable transversely to the conveying device and/or transversely to the direction of conveyance.

16. The installation according to claim 15, wherein the pushing device comprises the drive configured for transverse conveying of the fork.

17. The installation according to claim 15, wherein the fork of the pushing device can be moved in both directions transversely to the direction of conveyance.

18. The installation according to claim 14, wherein the pushing device is mounted on a guide rail that runs transversely to the first and second transport tracks.

19. The installation according to claim 14, wherein that the conveying device comprises a conveyor belt with two transport tracks and a common drive system, or wherein the conveying device comprises two separate conveyor belts, each of which forms the transport tracks.

20. The installation according to claim 14, wherein each pushing device is assigned an intermediate plate arranged between the conveyor belts.

* * * * *